US012351288B1

(12) United States Patent
Neveau

(10) Patent No.: US 12,351,288 B1
(45) Date of Patent: Jul. 8, 2025

(54) SYSTEMS AND METHODS FOR CONTROLLING MARINE DRIVES

(71) Applicant: Brunswick Corporation, Mettawa, IL (US)

(72) Inventor: Lukas G. Neveau, Oshkosh, WI (US)

(73) Assignee: Brunswick Corporation, Mettawa, IL (US)

( * ) Notice: Subject to any disclaimer, the term of this patent is extended or adjusted under 35 U.S.C. 154(b) by 316 days.

(21) Appl. No.: 18/101,438

(22) Filed: Jan. 25, 2023

(51) Int. Cl.
*B63H 21/21* (2006.01)

(52) U.S. Cl.
CPC ..... *B63H 21/213* (2013.01); *B63H 2021/216* (2013.01)

(58) Field of Classification Search
CPC ..... B63H 21/213; B63H 2021/216
See application file for complete search history.

(56) References Cited

U.S. PATENT DOCUMENTS

| | | | | |
|---|---|---|---|---|
| 5,340,342 | A | 8/1994 | Boda et al. | |
| 5,632,657 | A | 5/1997 | Henderson | |
| 6,840,888 | B1 * | 1/2005 | Winquist | B63H 21/213 477/110 |
| 8,257,122 | B1 | 9/2012 | Holley | |
| 9,248,898 | B1 | 2/2016 | Kirchhoff et al. | |
| 9,764,813 | B1 | 9/2017 | Zarembka et al. | |
| 9,789,945 | B1 | 10/2017 | Vaninetti et al. | |
| 10,246,173 | B1 | 4/2019 | Ingebritson | |
| 10,507,898 | B1 * | 12/2019 | Belter | B63H 21/213 |
| 10,696,367 | B1 | 6/2020 | Ingebritson et al. | |
| 10,787,236 | B1 | 9/2020 | Erickson et al. | |
| 11,097,826 | B1 | 8/2021 | Dannenberg et al. | |
| 11,186,352 | B1 | 11/2021 | Erickson et al. | |

OTHER PUBLICATIONS

Unpublished U.S. Appl. No. 17/585,214, filed Jan. 26, 2022 by Keith W. Schmidt.
Unpublished U.S. Appl. No. 17/881,018, filed Aug. 4, 2022 by Scott G. Ahlswede.
Unpublished U.S. Appl. No. 17/985,452, filed Nov. 11, 2022 by Ryan Abellera.
Unpublished International Patent Application No. PCT/US2022/052380 filed on Dec. 9, 2022 by John A. Groeschel.
Unpublished U.S. Appl. No. 17/487,116, filed Sep. 28, 2021 by Ryan Fergus.
Unpublished U.S. Appl. No. 17/967,226, filed Oct. 17, 2022 by John A. Groeschel.

* cited by examiner

*Primary Examiner* — Calvin Cheung
(74) *Attorney, Agent, or Firm* — Andrus Intellectual Property Law, LLP

(57) ABSTRACT

A method for controlling a marine drive having a throttle handle moveable to control a thrust and a detent engageable to resist moving the throttle handle. The method includes configuring a position sensor to generate position data corresponding to positions of the throttle handle and receiving the position data from the position sensor. The method further includes analyzing the position data to determine a first position of the throttle handle in which the detent disengages and generating thrust with the marine drive when the throttle handle is moved into the first position.

20 Claims, 10 Drawing Sheets

SYSTEMS AND METHODS FOR CONTROLLING MARINE DRIVES

FIELD

The present disclosure relates to systems and methods for controlling marine drives, and particularly for controlling marine drives having moveable throttle handles.

BACKGROUND

The following U.S. patents and patent Applications are incorporated herein by reference:

U.S. Pat. No. 11,186,352 discloses a tiller system for steering a marine propulsion device. The tiller system includes a tiller arm rotatably coupled to the marine propulsion device. The tiller arm is rotatable from a down position to an up position through a plurality of lock positions therebetween. A toothed member is coupled to one of the tiller arm and the marine propulsion device. The toothed member defines a plurality of teeth corresponding to the plurality of lock positions for the tiller arm. A pawl is coupled to another of the tiller arm and the marine propulsion device, where the pawl engages with the plurality of teeth to prevent the tiller arm from rotating downwardly through the plurality of lock positions.

U.S. Pat. No. 11,097,826 discloses a tiller for an outboard marine drive including a tiller body that is elongated along a tiller axis between a fixed end connected to an outboard marine drive and a distal end. A lanyard switch on the tiller body is configured to prevent operation of the outboard marine drive when a lanyard clip is not attached to the lanyard switch. A controller is configured to identify that an operator has provided operator input to start the outboard marine drive and that the lanyard clip is not connected to the lanyard switch. The controller then generates a lanyard error alert identifying that the lanyard clip is not connected to the lanyard switch.

U.S. Pat. No. 10,787,236 discloses a tiller system for steering an outboard motor. The tiller system includes a tiller arm that is rotatably coupled to the outboard motor. The tiller arm is rotatable from a down position to an up position through a plurality of lock positions therebetween. A tilt lock system is coupled between the tiller arm and the outboard motor and is configured to be activated and deactivated. When activated, the tilt lock system prevents the tiller arm from rotating downwardly through each of the plurality of lock positions. The tiller arm is further rotatable into an unlock position, whereby rotating the tiller arm into the unlock position automatically deactivates the tilt lock system such that the tiller arm is freely rotatable downwardly through the plurality of lock positions.

U.S. Pat. No. 10,696,367 discloses a tiller for an outboard motor has a throttle grip that is manually rotatable through first and second ranges of motion into and between an idle position in which the outboard motor is controlled at an idle speed, and first and second open-throttle positions, respectively, in which the outboard motor is controlled at an above-idle speed. A throttle shaft is coupled to the throttle grip and is configured so that rotation of the throttle grip causes rotation of the throttle shaft, which changes a throttle position of a throttle of the outboard motor. A rotation direction switching mechanism is manually position-able into a first position in which rotation of the throttle grip through the first range of motion controls the throttle of the outboard motor and alternately manually position-able into a second position in which rotation of the throttle grip through the second range of motion controls the throttle position.

U.S. Pat. No. 10,246,173 discloses a tiller for an outboard motor having a manually operable shift mechanism configured to actuate shift changes in a transmission of the outboard motor amongst a forward gear, reverse gear, and neutral gear. The tiller also has a manually operable throttle mechanism configured to position a throttle of an internal combustion engine of the outboard motor into and between the idle position and a wide-open throttle position. An interlock mechanism is configured to prevent a shift change in the transmission out of the neutral gear when the throttle is positioned in a non-idle position. The interlock mechanism is further configured to permit a shift change into the neutral gear regardless of where the throttle is positioned.

U.S. Pat. No. 9,764,813 discloses a tiller for an outboard motor. The tiller comprises a tiller body that is elongated along a tiller axis between a fixed end and a free end. A throttle grip is disposed on the free end. The throttle grip is rotatable through a first (left-handed) range of motion from an idle position in which the outboard motor is controlled at idle speed to first (left-handed) wide open throttle position in which the outboard motor is controlled at wide open throttle speed and alternately through a second (right-handed) range of motion from the idle position to a second (right-handed) wide open throttle position in which the outboard motor is controlled at wide open throttle speed.

U.S. patent application Ser. No. 17/487,116 discloses an outboard motor including a transom clamp bracket configured to be supported on a transom of a marine vessel and a swivel bracket configured to be supported by the transom clamp bracket. A propulsion unit is supported by the swivel bracket, the propulsion unit comprising a head unit, a midsection below the head unit, and a lower unit below the midsection. The head unit, midsection, and lower unit are generally vertically aligned with one another when the outboard motor is in a neutral tilt/trim position. The propulsion unit is detachable from the transom clamp bracket.

U.S. patent application Ser. No. 17/585,214 discloses a marine drive is for propelling a marine vessel. The marine drive has a propulsor configured to generate a thrust force in a body of water; a battery that powers the propulsor; and a supporting frame which supports the marine drive relative to marine vessel. The supporting frame has a monolithic body defining a frame interior, and further has a support leg extending downwardly from the monolithic body and a steering arm extending forwardly from monolithic body. A cowling is fixed to the supporting frame via at least one hidden fastener that extends from the frame interior, through the supporting frame, and into engagement with the cowl body, wherein hidden fastener being accessible during installation.

International and U.S. Pat. App. No. PCT/US2022/052380, Ser. No. 17/881,018, and Ser. No. 17/967,226 relate to transportable outboard motors each having a midsection and a tiller extending forwardly from the midsection.

U.S. patent application Ser. No. 17/985,452 discloses an adaptable throttle unit for controlling a marine drive. A housing having first and second sides is coupleable to a marine vessel in a first orientation with the first side above the second side and in a second orientation with the first side below the second side. A throttle lever is configured to be rotatably coupled at an end to the housing such that a handle is above the end both when the housing is in the first orientation and in the second orientation. A sensor measures rotation of the throttle lever. A controller requests forward propulsion of the marine drive when the sensor measures rotation of the throttle lever in a first direction and the housing is in the first orientation, and alternately reverse propulsion when the sensor measures rotation of the throttle lever in the first direction when the housing is in the second orientation.

SUMMARY

This Summary is provided to introduce a selection of concepts that are further described herein below in the Detailed Description. This Summary is not intended to identify key or essential features of the claimed subject matter, nor is it intended to be used as an aid in limiting scope of the claimed subject matter.

One aspect of the present disclosure generally relates to a method for controlling a marine drive having a throttle handle moveable to control a thrust and a detent engageable to resist moving the throttle handle. The method includes configuring a position sensor to generate position data corresponding to positions of the throttle handle and receiving the position data from the position sensor. The method further includes analyzing the position data to determine a first position of the throttle handle in which the detent disengages and generating thrust with the marine drive when the throttle handle is moved into the first position.

Another aspect of the present disclosure generally relates to a control system for controlling a marine drive via a position sensor that generates position data corresponding to positions of the throttle handle. A controller is configured to receive the position data from the position sensor and analyze the position data to determine a first position of the throttle handle in which the detent disengages. The controller generates thrust with the marine drive when the throttle handle is moved into the first position.

BRIEF DESCRIPTION OF THE DRAWINGS

Examples are described with reference to the following drawing figures. The same numbers are used throughout to reference like features and components.

DETAILED DESCRIPTION

Figure 1:
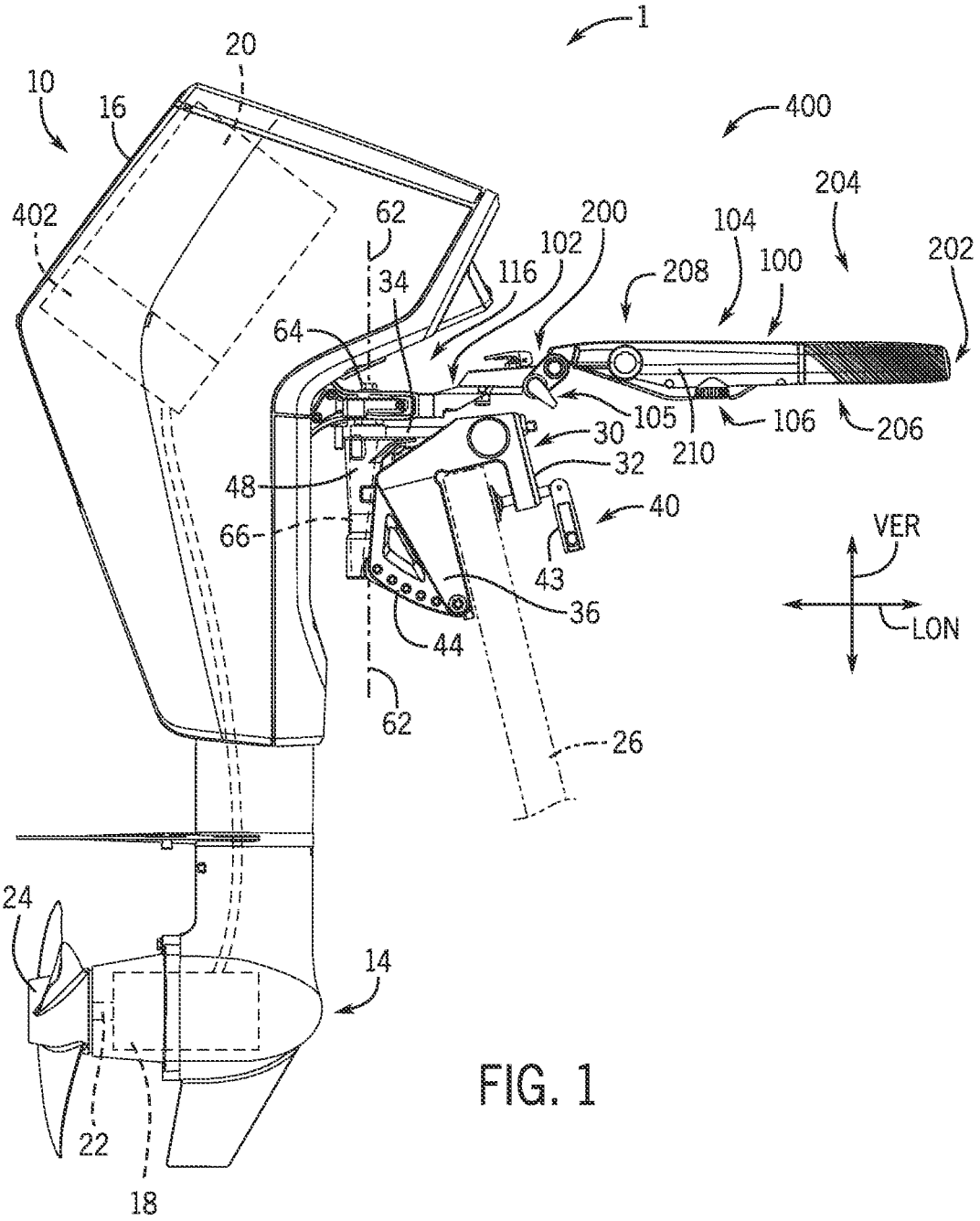
FIG. 1 is a side view of a marine drive having a first exemplary throttle handle and being controllable according to the present disclosure.

FIG. 1 depicts a marine drive 1 for propelling a marine vessel in a body of water, which in the illustrated example is an outboard motor 10. The outboard motor 10 extends from top to bottom in a vertical direction VER, from front to back in a longitudinal direction LON that is perpendicular to the vertical direction VER, and from side to opposite side in a lateral direction LAT (see e.g., FIG. 2) that is perpendicular to both the vertical direction VER and the longitudinal direction LON. The outboard motor 10 includes a supporting frame (not shown) for rigidly supporting the various components of the outboard motor 10 with respect to the marine vessel and a gearcase 14 secured to the supporting frame. A cowling 16 is fixed to and surrounds most or all of the supporting frame, as further disclosed in U.S. patent application Ser. No. 17/585,214, the disclosure of that is hereby incorporated herein by reference in entirety. The cowling 16 defines a cowling interior in which a portion of the supporting frame is enclosed and various components of the outboard motor 10 are disposed. It should be understood that the various components described above are exemplary and could vary from what is shown.

The outboard motor 10 generally includes a powerhead configured to produce torque, such as an electric motor 18, an internal combustion engine (e.g., a gasoline or diesel-powered engine), or a hybrid thereof. Additional information regarding powerheads is also provided in U.S. Pat. No. 10,800,502, the disclosure of that is hereby incorporated herein by reference in entirety. The outboard motor 10 further includes a power source 20 to provide power to the electric motor 18. The power source 20 may be a rechargeable battery as described in U.S. patent application Ser. No. 17/585,214, which was incorporated by reference above.

The electric motor 18 is coupled in torque transmitting relation with a propulsor shaft 22 extending from the gearcase 14 such that rotation of the propulsor shaft causes rotation of a conventional propulsor 24, which in turn generates a thrust force for propelling the marine vessel in water. The type and configuration of the propulsor can vary, and for example can include one or more propellers, impellers, and/or the like. Various gearsets and/or transmissions may also be operatively coupled between the electric motor 18 and the propulsor 24.

With continued reference to FIG. 1, the outboard motor 10 is coupled to the transom 26 of a marine vessel by a transom bracket assembly 30, which in the illustrated example includes a transom bracket 32 fixed to the transom 26 and a swivel bracket 34 pivotably coupled to the transom bracket 32. The transom bracket 32 has a pair of C-shaped arms 36 that fit over the top of the transom 26 and a pair of threaded, plunger-style clamps 40 which clamp the C-shaped arms 36 to the transom 26. Rotation of handles 43 in one direction clamps the transom 26 between the C-shaped arms 36 and plunger-style clamps 40. Rotation of the handles 43 in the opposite direction frees the C-shaped arms 36 for removal from the transom 26. The type and configuration of the transom bracket 32 can vary from what is shown and described. In other examples, the transom bracket 32 is fixed to the transom 26 by fasteners.

The swivel bracket 34 is pivotable with respect to the C-shaped arms 36 about a pivot shaft that laterally extends through the forward upper ends of the C-shaped arms 36, thereby defining a trim axis. Pivoting of the swivel bracket 34 about the pivot shaft trims the outboard motor 10 relative to the marine vessel, for example out of and/or back into the body of water in which the marine vessel is operated. A selector bracket 44 having holes is provided on at least one of the C-shaped arms 36. Holes respectively become aligned with a corresponding mounting hole on the swivel bracket 34 at different selectable trim positions for the outboard motor 10. A selector pin (not shown) can be manually inserted into the aligned holes to thereby lock the outboard motor 10 in place with respect to the trim axis, all as is conventional.

The outboard motor 10 is supported on the swivel bracket 34 by a steering arm 64 and a steering tube 66, which is fixed to the steering arm 64 and seated in a swivel cylinder 48 of the swivel bracket 34. The steering arm 64 has a first end that is fixed to a supporting frame or other component of the outboard motor 10 and an opposite, second end configured to be coupled to a manually operable tiller 100. The outboard motor 10 can be steered left or right relative to the marine vessel by rotating about a steering axis 62 defined by the steering tube 66 and swivel cylinder 48 via the tiller 100.

In general, the tiller 100 has a base bracket assembly 102 and a tiller arm 104 that is coupled to and extends outwardly from the base bracket assembly 102. The tiller arm 104 extends from an inner end 200 to an outer end 202 in a longitudinal direction LON, from top 204 to bottom 206 in a vertical direction VER that is perpendicular to the longitudinal direction LON, and from a first side 208 to a second side 210 that is opposite the first side 208 in a lateral direction LAT that is perpendicular to the longitudinal direction LON and perpendicular to the vertical direction VER.

Figure 2:
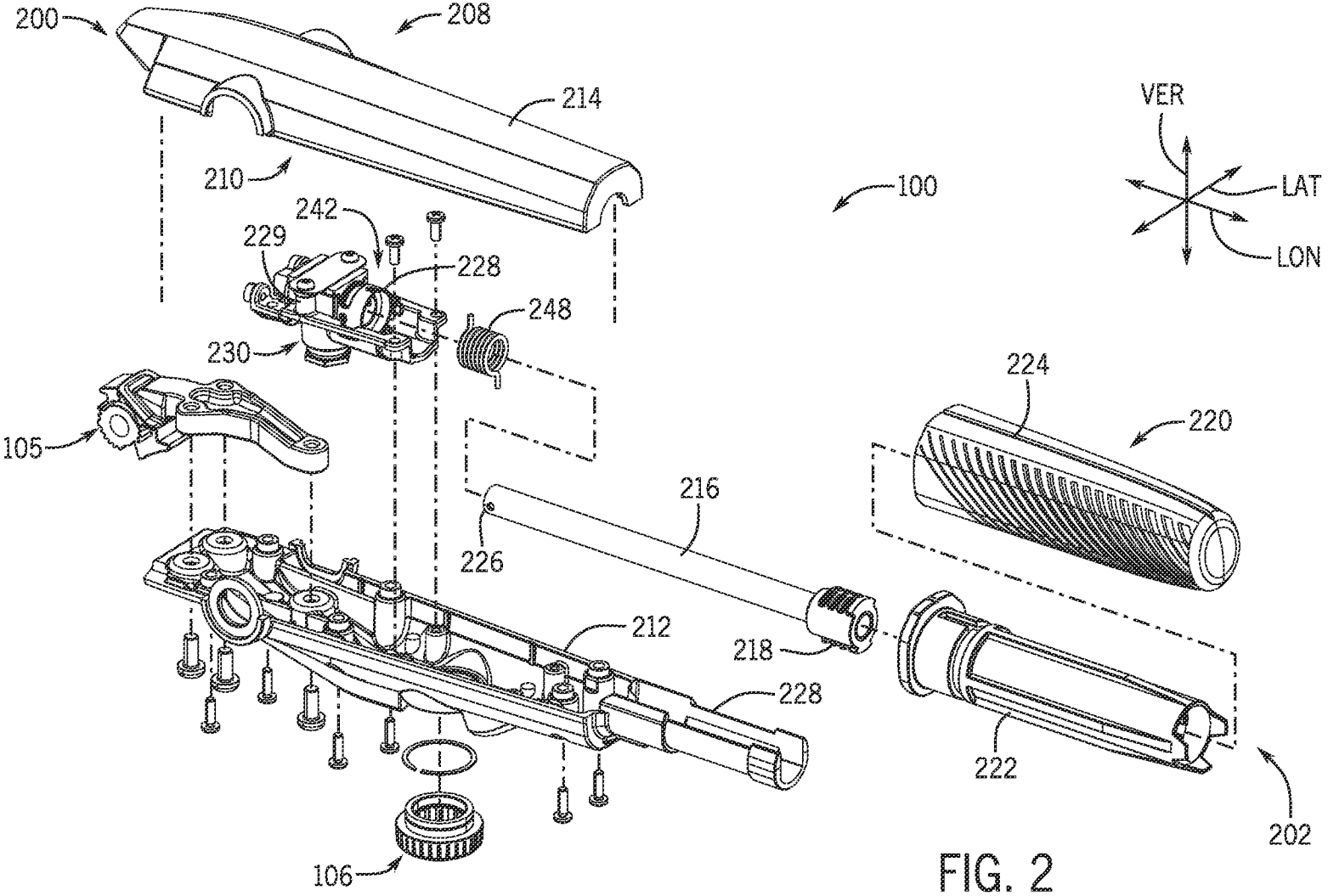
FIG. 2 is an exploded view illustrating the throttle handle of FIG. 1.

Referring to FIG. 2, additional information is now provided regarding one non-limiting example of a tiller 100. Certain components of the tiller 100 are not discussed herein but are discussed in U.S. patent application Ser. Nos. 17/967,226 and 17/881,018, which were incorporated by reference above. By way of example, these include a trim mechanism 105 for adjusting the tilt angle of the tiller 100 relative to the transom 26 of the marine vessel as shown in FIG. 1, as well as a grip restraining device 106 for adjusting the difficulty in the operator rotating the hand grip (discussed further below) of the tiller 100.

The tiller arm 104 of FIG. 2 has a chassis 212 that is elongated in the longitudinal direction LON and underlies and supports various components associated with the tiller arm 104. A cover 214 is mounted on top of chassis 212 and encloses the various components in an interior of the tiller arm 104. A shaft 216 protrudes from the interior via a passage defined between the front of the chassis 212 and cover 214. The shaft 216 is rotatable about its own axis and has a front end 218 that is coupled to a hand grip 220. The hand grip 220 includes a grip member 222 and a grooved grip cover 224. The shaft 216 is coupled to the hand grip 220 such that manually rotating the hand grip 220 relative to the chassis 212 and cover 214 causes rotation of the shaft 216 relative to the chassis 212 and cover 214. The shaft 216 has a rear end 226 that includes a shaft extension 228 located within a supporting tray 230.

A magnetic position sensor 229 is mounted to the supporting tray 230 and is configured to sense rotation of the shaft 216 (via the shaft extension 228) and communicate such sensed rotation to a controller for the associated marine drive. Sensing arrangements for sensing rotation of a shaft in a tiller arm are conventional and well known in this art and thus not further herein described. As such, it will be understood that rotation of the hand grip 220 causes rotation of the shaft 216, including shaft extension 228 within the supporting tray 230 and such rotation in turn causes change in the speed of the marine drive. In this manner, the tiller 100 the rotatable hand grip 220 is also referred to as a throttle handle useable to control the thrust generated by the marine drive.

Figure 3:
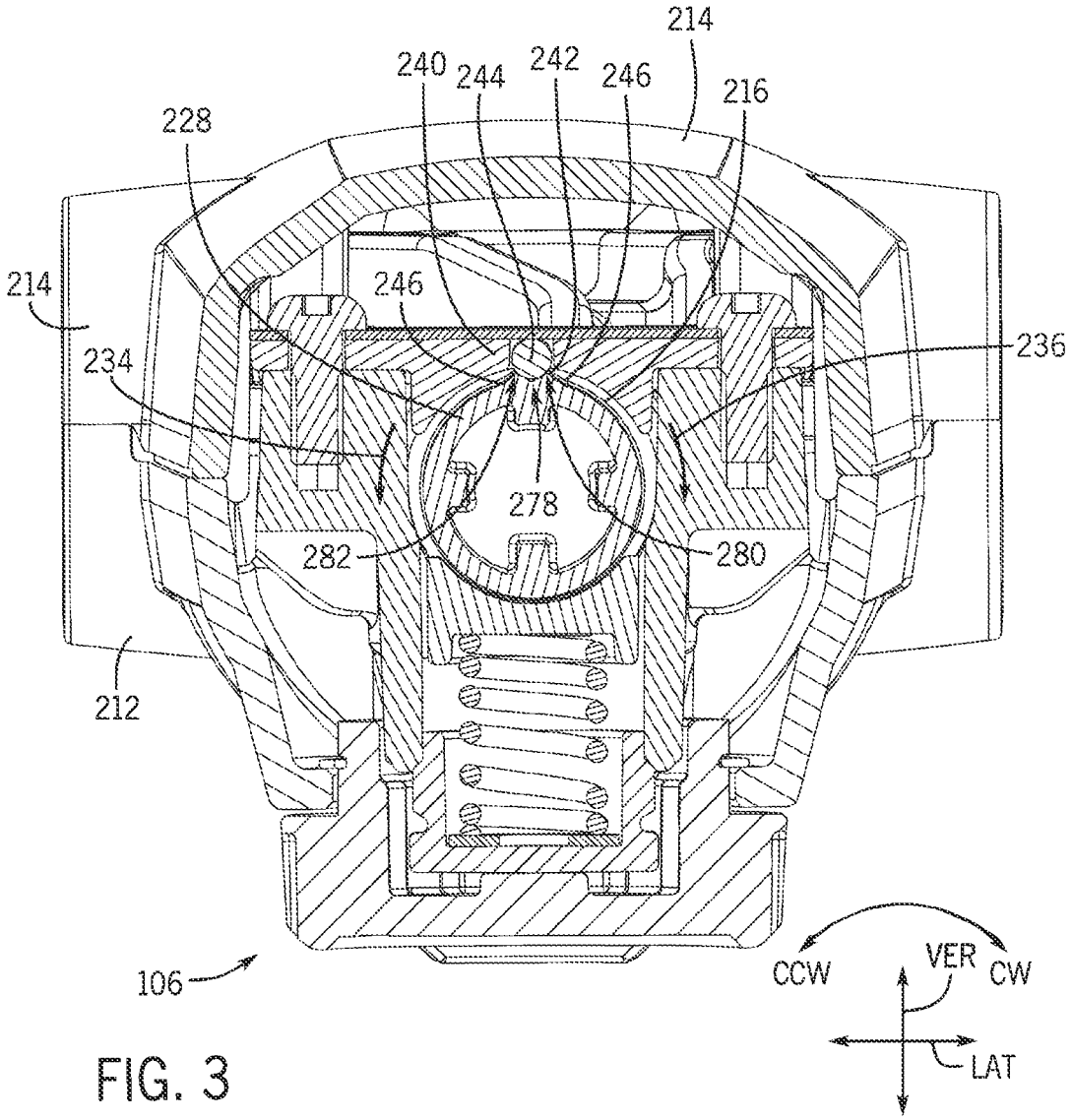
FIG. 3 is a sectional end view illustrating the throttle handle of FIG. 1.

Referring to FIGS. 2 and 3, the hand grip 220 and shaft 216, including shaft extension 228, are rotatable in opposite directions away from the center position shown and thus is configured for ambidextrous use. That is, the hand grip 220 can be rotated from the center position in the a first direction of arrow 234 (e.g., counterclockwise, CCW) to increase the thrust of the marine drive in a first direction in the body of water (e.g., in a forward direction) or rotated from the center position in an opposite second direction of arrow 236 (e.g., clockwise, CW) to increase the thrust of the marine drive in a second direction in the body of water (e.g., in a reverse direction opposite the forward direction). It should be recognized that subsequently rotating back towards the center position decreases the thrust until no thrust is produced at the center position. It should be recognized that the present disclosure also contemplates configurations in which the hand grip 220 is moveable other than rotation.

Figure 7:
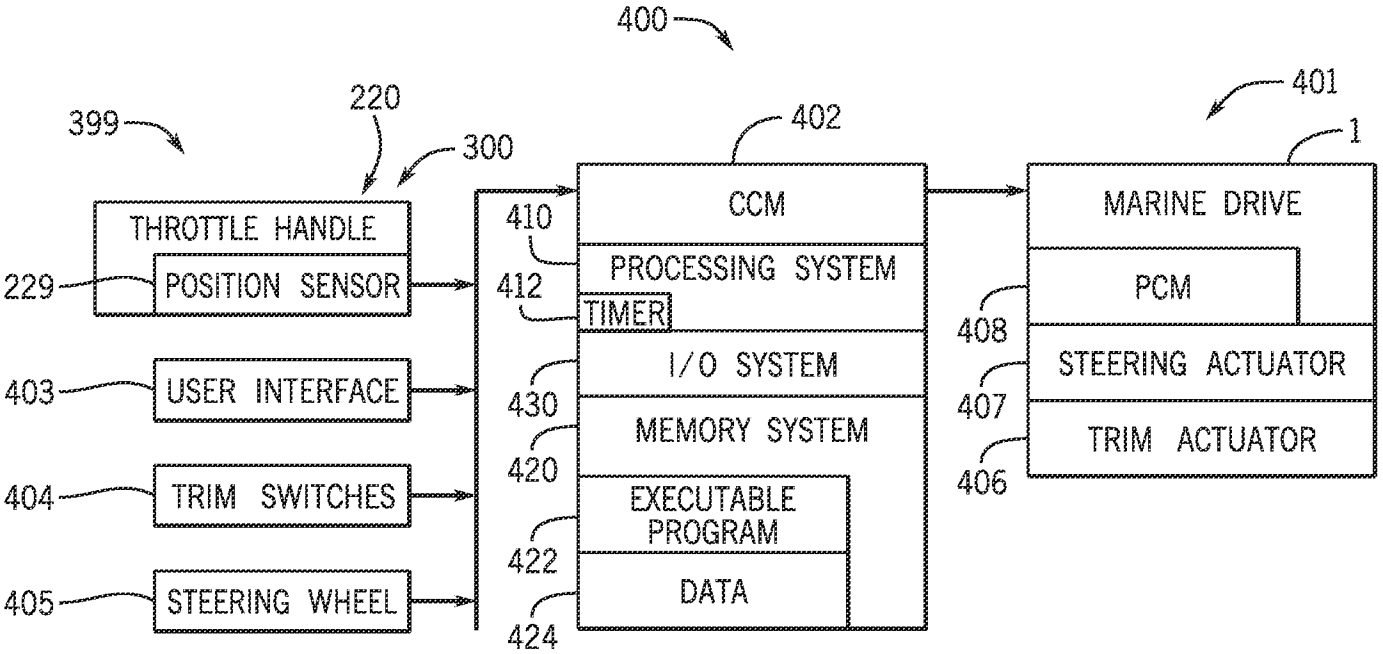
FIG. 7 illustrates an exemplary control system for controlling a marine vessel using the throttle handles of FIG. 1 or 6.

The hand grip 220 may alternatively be configured such that CCW rotation from the center position increases thrust in the reverse direction and CW rotation from the center position increases thrust in the forward direction. Since the position, and thus movement, of the hand grip 220 is determined by the position sensor 229, alternating the configuration of the hand grip 220 may be established via software within the control system 700 discussed further below (FIG. 7). In other words, changes for preference or handedness do not require changes to hardware.

With continued reference to FIGS. 2 and 3, a detent mechanism 240 (also referred to as simply a detent) provides tactile feedback to the operator grasping the hand grip 220 when the hand grip 220 is rotated into the center position shown, which corresponds to neutral position for the marine drive. This is also referred to as the detent being engaged in the neutral position. The detent mechanism 240 includes a raised groove 242 on the top of the outer diameter of the shaft extension 228. The raised groove 242 has a first neutral edge 280 and a second neutral edge 281 with the neutral position 278 being defined therebetween. A roller pin 244 is coupled to the supporting tray 230 and becomes aligned with and pops into the raised groove 242 when the hand grip 220 and shaft 216 are rotated into the center position. Seating of the roller pin 244 provides tactile feedback in the form of a click, which can be felt by the operator grasping the hand grip 220. Smoothly contoured surfaces 246 provide ramps on opposite sides of the raised groove 242 leading up to the groove and thus provide a gradually increasing resistance to the operator rotating the hand grip 220 towards the center position until the roller pin 244 becomes aligned with and seats in the raised groove 242.

Figure 4:
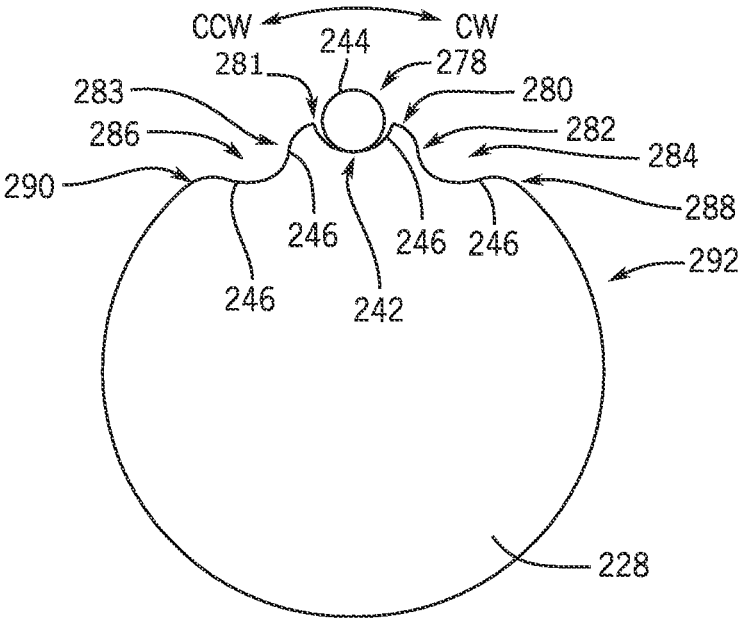
FIG. 4 is a close-up view illustrating a portion of the throttle handle of FIG. 3.

As shown in FIGS. 3 and 4, the shaft extension 228 further includes a first non-neutral edge 282 and a second non-neutral edge 283 formed clockwise CW and counterclockwise CCW of the neutral position 278, respectively. The first non-neutral edge 282 and the second non-neutral edge 283 are the rotational positions at which the interaction between the roller pin 244 and the ramp of the contoured surface 246 no longer cause the hand grip 220 to rotate (here, away from the neutral position 278) in the process of disengaging from the neutral position 278. The detent may be referred to as being engaged in the neutral position across the entire range of positions in which the ramp of the contoured surface 246 causes rotation of the hand grip 220 despite the roller pin 244 no longer being positioned between the first neutral edge 280 and the second neutral edge 281 within the interior of the raised groove 242.

Returning to FIGS. 2 and 3, a coiled torsion spring 248 is disposed on the shaft 216 and has a first end attached to the shaft 216 and an opposite, second end attached to the supporting tray 230. In other examples, the coiled torsion spring 248 can include one of two or more springs having opposite winding. The torsion spring 248 rotationally biases the shaft 216 towards the center position shown in FIG. 3. However, the bias force provided by the torsion spring 248 is not great enough to overcome the engagement force between the roller pin 244 and the ramped surfaces 246. Instead, it is necessary to apply manual rotational force on the shaft 216 via the hand grip 220 to bring the raised groove 242 into alignment with the roller pin 244, as well as to bring the neutral position 278 (or a first idle position 284 or a second idle position 286 as discussed below and shown in FIG. 4) out of alignment with the roller pin 244. As such, it will be understood that manually grasping and rotating the hand grip 220 away from the center position in either direction 234, 236 increases the speed of the marine drive. Manually releasing the hand grip 220 permits the bias of the torsion spring 248 to rotate the shaft 216 and hand grip 220 back towards the center position until the respective ramped surface 246 engages the roller pin 244. To fully move the hand grip 220 back to the center position, the operator must grasp and rotate the hand grip 220 with a force needed to push the ramped surface 246 past the roller pin 244 so that the roller pin 244 will pop into place in the raised groove 242.

Additional components relating to the grip restraining device 106 for adjusting the difficulty in the operator rotating the hand grip 220 are also shown in FIG. 3, but not discussed herein (see U.S. patent application Ser. Nos. 17/967,226 and 17/881,018).

In certain embodiments, such as shown in FIG. 4, the detent mechanism 240 is engageable not only in the neutral position 278, but also in a first idle position 284 and a second idle position 286. The first idle position 284 and the second idle position 286 are formed as additional grooves within the outer diameter of the shaft extension 228 in a similar manner to the raised groove 242 corresponding to the neutral position 278. In particular, a third non-neutral edge 288 is provided further clockwise CW relative to the first non-neutral edge 282, whereby the first idle position 284 is thus defined between the first non-neutral edge 282 and the third non-neutral edge 288. The third non-neutral edge 288 is the position at which the ramp of the contoured surface 246 no longer causes rotation of the hand grip 220 and the first idle position 284 is considered disengaged.

Similarly, a fourth non-neutral edge 290 is provided further counterclockwise CCW relative to the second non-neutral edge 283, whereby the second idle position 286 is thus defined between the second non-neutral edge 283 and the fourth non-neutral edge 290. In the illustrated example, contoured surfaces 246 provide ramps on opposites sides of the first idle position 284 and of the second idle position 286 in a similar manner as those for the raised groove 242 of the neutral position 278.

In this manner, the detent mechanism 240 resists rotating the hand grip 220 when engaged in the neutral position 278, the first idle position 284, or the second idle position 286. It should also be recognized that the positions at which detent is considered engaged or disengaged may vary from that discussed here, for example with the neutral position 278 being considered disengaged starting at the first neutral edge 280 rather than at the first non-neutral edge 282 (and likewise for other detent engagement positions and rotation directions). As will become apparent, the defining the engagement and disengagement positions change how the marine drive is controlled relative to these positions of the throttle handle. In a configuration in which the detent is considered disengaged from the neutral position starting at the first neutral edge 280, thrust is generated earlier than if the detent is not considered disengaged until reaching the first non-neutral edge 282. Other positions for defining the transition from engagement to disengagement are also contemplated.

Figure 5:
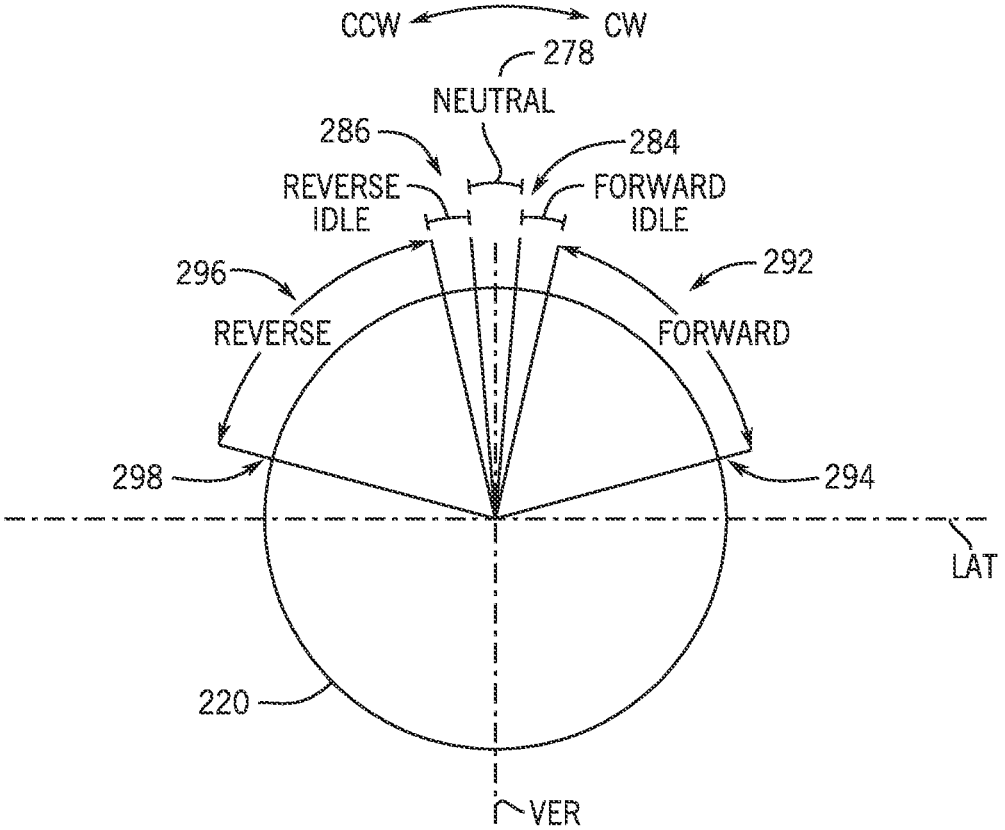
FIG. 5 depicts control of the marine drive based on positions of the throttle handle of FIG. 1.

FIG. 5 depicts one configuration for controlling the thrust of a marine drive based on the rotational position of the hand grip 220. As discussed above, and with additional reference to FIGS. 3-4, the marine drive is controlled to be in neutral when the hand grip 220 is positioned such that the roller pin 244 (FIG. 3) is positioned within the neutral position 278. In other words, the marine drive is controlled such that no thrust is generated when the detent is engaged in the neutral position 278. As the hand grip 220 is rotated from the neutral position 278 in the first direction (here, clockwise, CW), the detent remains engaged within this neutral position until the roller pin 244 reaches or exceeds the first neutral edge 280 of the outer diameter of the shaft extension 228. As discussed above, the neutral position could alternatively be considered engaged until reaching the first non-neutral edge 282 or another position. Whichever position is considered to correspond to the detent disengaging from the neutral position 278 is also be referred to as the first position with respect to controlling the marine drive thrust, which corresponds to the first position at which thrust is generated.

In the illustrated embodiment, the detent subsequently engages within the first idle position 284. In this first idle position 284, the marine drive is controlled to generate thrust in a first direction (e.g., in the forward direction), but at an idle speed. Further rotation in the first direction CW causes the detent to disengage from the first idle position 284, after which point the hand grip 220 may move freely among and between a first range of running positions 292 until reaching a first end stop 294. Rotating the hand grip 220 farther from the neutral position 278 further increases the thrust generated by the marine drive until the first end stop 294 is reached, and likewise rotating the hand grip 220 towards the neutral position 278 decreases the thrust.

It should further be recognized that the directionality of the thrust is determined by whether the throttle handle is positioned clockwise CW or counterclockwise CCW relative to the neutral position 278. With continued reference to FIGS. 4 and 5, rotating the hand grip 220 from the neutral position 278 in the second direction (here, counterclockwise, CCW), the detent remains engaged within this neutral position 278 until the roller pin 244 (FIG. 3) reaches or exceeds the second non-neutral edge 283 of the outer diameter of the shaft extension 228. The detent subsequently engages within the second idle position 286. In this second idle position 286, the marine drive is controlled to generate thrust in a second direction (e.g., in the reverse direction) at an idle speed. Further rotation in the second direction, counterclockwise CCW, causes the detent to disengage from the second idle position 286 at which point the hand grip 220 move freely among and between a second range of running positions 296 until reaching a second end stop 298. It should be recognized that rotating the hand grip 220 farther from the neutral position 278 further increases the thrust generated by the marine drive until the second end stop 298 is reached, and likewise rotating the hand grip 220 towards the neutral position 278 decreases the thrust, now in the reverse direction.

Figure 6:
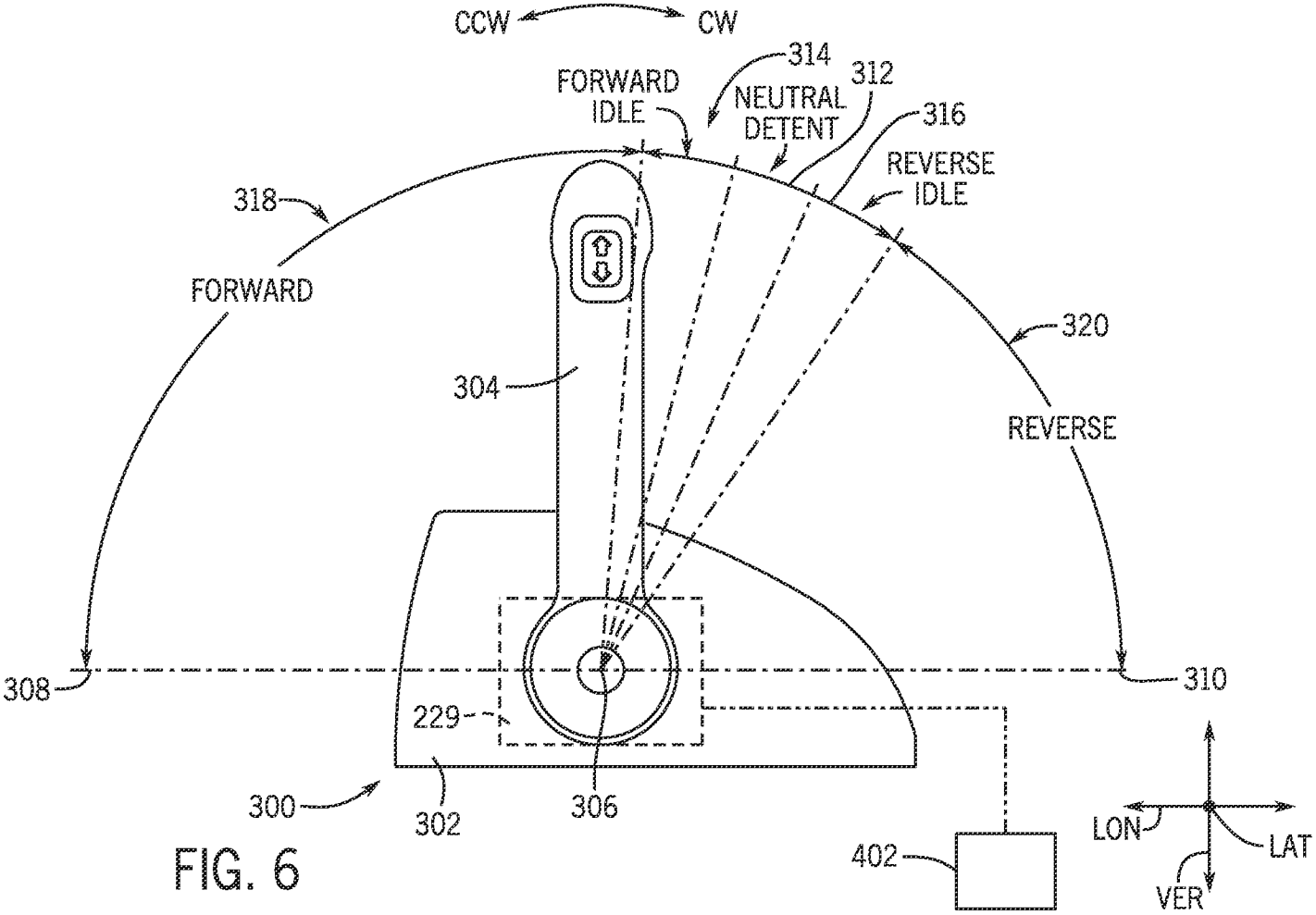
FIG. 6 is a side view of a second exemplary throttle handle for controlling a marine drive according to the present disclosure.

FIG. 6 depicts another type of throttle handle for controlling the thruster generated by a marine drive, in this case being a helm throttle control 300 similar to those conventionally provided at a helm. The helm throttle control 300 is used in conjunction with another mechanism used for steering, such as a steering wheel. The helm throttle control 300 has a base 302 configured to be coupled to a marine vessel, such as on an interior wall of the hull or a raised center console. An elongated throttle lever 304 is pivotally coupled to the base 302 so as to rotate about an axis 306 extending substantially parallel to the lateral axis LAT. Like the hand grip 220 shown in FIGS. 1-5, the throttle lever 304 is rotatable between a first end stop 308 and a second end stop 310 having three detent engagement positions therebetween: a neutral position 312 at approximately the center between the first end stop 308 and the second end stop 310, a first idle position 314 rotationally adjacent to the neutral position 312 (here, shown counterclockwise CCW relative to the neutral position 312), and a second idle position 316 rotationally adjacent to the neutral position 312 on the opposite side, (here, shown clockwise CW). The marine drive does not generate thrust when the throttle lever 304 is in the neutral position 312 and generates thrust at an idle speed in the first idle position 314 and in the second idle position 316 (here in forward and reverse directions, respectively). Rotating the throttle lever 304 farther from the neutral position 312 increases the thrust within a first range of running positions 318 until reaching the first end stop 308, and likewise within a second range of running positions 320 until reaching the second end stop 310.

The physical features defining the detent engagement positions may be the same or similar to those shown for the tiller 100 in FIGS. 1-5, for example having the same detent mechanism 240 and the contours on the outer diameter of a shaft rotated by rotating the throttle lever 304. Control of the thrust may also function in the same or a similar manner as the tiller 100 of FIGS. 1-5, including the use of the same or a similar position sensor 229 to generate position data corresponding to the position of the throttle lever 304. In short, from the perspective of controlling thrust, the helm throttle control 300 and the tiller 100 largely vary in that the helm throttle control 300 rotates parallel to the lateral axis LAT, whereas the hand grip 220 rotates parallel to an axis that moves as the marine drive is steered with the tiller 100.

With reference to FIG. 7, additional information is now provided for a control system 400 configured to control a marine drive via a throttle handle such as the hand grip 220 or the helm throttle control 300 discussed above. It should be recognized that certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices. The connections between functional and logical block components are merely exemplary, which may be direct or indirect, and may follow alternate pathways.

In certain examples, the control system 400 communicates with each of the one or more components of the marine drive via a communication link CL, which can be any wired or wireless link. The control system 400 includes a central control module CCM 402 capable of receiving information and/or controlling one or more operational characteristics of the marine drive and its various sub-systems by sending and receiving control signals via the communication links CL, which may be of a type conventionally known. In one example, the communication link CL is a controller area network (CAN) bus; however, other types of links could be used. It will be recognized that the extent of connections and the communication links CL may in fact be one or more shared connections, or links, among some or all of the components in the control system 400. Moreover, the communication link CL lines are meant only to demonstrate that the various control elements are capable of communicating with one another, and do not represent actual wiring connections between the various elements, nor do they represent the only paths of communication between the elements. Additionally, the control system 400 may incorporate various types of communication devices and systems, and thus the illustrated communication links CL may in fact represent various different types of wireless and/or wired data communication systems. It should further be recognized that the individual components of the control system 400 may be located other than as shown, by way of example being positioned entirely within a marine drive 1, or at least partially elsewhere within a marine vessel separate than the one or more marine drives provided therewith.

The central control module CCM 402, also referred to as the controller, may be a computing system that includes a processing system 410, memory system 420, and input/output (I/O) system 430 for communicating with other devices, such as input devices 399 and output devices 401. Examples of input devices 399 include position sensors 229 configured to generate position data corresponding to the rotational positions of the throttle handle as discussed above. Other input devices 399 may include a user interface 403 such as Mercury Marine's VesselView® digital control module, trim switches 404, a steering wheel 405, joystick, and/or other conventionally known inputs to a central control module CCM 402. The trim switches 404 and steering wheel 405 control the trim angle of the marine drive via trim actuators 406 and the steering of the marine vessel via steering actuators 407 as output devices 401 of the control system 400, respectively. Additional information regarding trim switches, actuators, and position sensors may be found in U.S. Pat. Nos. 6,583,728; 7,156,709; 7,416,456; and 9,359,057; 10,137,971, which are incorporated by reference in entirety herein. Additional information regarding steering devices, actuators, and position sensors may be found in U.S. Pat. Nos. 7,150,664; 7,255,616; 7,467,595; 8,113,892, which are incorporated by reference in entirety herein.

Another output device 401 in the illustrated control system 400 of FIG. 7 is the outboard motor 10 (FIG. 1), and further a propulsion control module PCM 408 therein that controls the electric motor 18 of the outboard motor 10, including the thrust generated thereby. Control of the thrust generated by the marine drive 1 may instead or additionally be performed via another controller such as one or more engine control modules (ECMs), thrust vector control modules (TVMs), and/or helm control modules (HCMs), by way of example. Additional information regarding these control modules and communication therewith is provided in U.S. Pat. Nos. 9,994,296; 9,975,619; and 10,594,510, which are incorporated by reference in entirety herein.

With continued reference to FIG. 7, the processing system 410 loads and executes an executable program 422 from the memory system 420, accesses data 424 stored within the memory system 420, and directs the marine drive to operate as described herein, including with respect to the control of thrust generated by the marine drive via the throttle handle.

The processing system 410 may be implemented as a single microprocessor or other circuitry or be distributed across multiple processing devices or sub-systems that cooperate to execute the executable program 422 from the memory system 420. Non-limiting examples of the processing system include general purpose central processing units, application specific processors, and logic devices.

The memory system 420 may comprise any storage media readable by the processing system 410 and capable of storing the executable program 422 and/or data 424. The data 424 may include stored reference waveforms, threshold values, and/or threshold ranges, which are discussed further below. The memory system 420 may be implemented as a single storage device or be distributed across multiple storage devices or sub-systems that cooperate to store computer readable instructions, data structures, program modules, or other data. The memory system 420 may include volatile and/or non-volatile systems and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example.

In general, the control system 400 is configured to receive position data generated by the position sensor 229, the position data corresponding to the position of the throttle handle (e.g., the hand grip 220 of FIGS. 1-5 or the throttle lever 304 of FIG. 6) as it moves from a first end stop to an opposite second end stop. The control system 400 then controls the marine drive to produce thrust corresponding to this position data, producing 100% thrust in a first direction at the first end stop, 0% thrust in the neutral position, and 100% thrust in a second, opposite direction at the second end stop. The control system 400 controls the marine drive to produce thrust at intermediate thrust percentages at positions between the first end stop and the second end stop, as is conventional.

Through experimentation and development, the present inventor has identified challenges in calibrating the position sensor 229 to be centered when the detent actually engages within the neutral position 278 (FIG. 5). In particular, the control system must be provided with the position data from the position sensor 229 that correspond to the detent being engaged in the neutral position 278 so as to not generate thrust when this position data is provided by the position sensor 229. Likewise, the detent mechanism 240 (FIG. 3) discussed above is intended to provide tactile feedback to the operator that the position of the hand grip 220 is such that no thrust will be generated. Thus, the actual detent engagement position must align with the positional data that generates no thrust.

However, the present inventor has identified that due to part-to-part variation in the physical components and/or position sensors, variation in the assembly process, tooling wear, and component wear all contribute to the physical position of the neutral position 278 varying across different throttle handles. Moreover, this position can vary over time due to wear. As such, conventionally known techniques would require a sizeable "dead band" across all throttle handle positions that could correspond to the neutral position to ensure that no thrust is generated when the detent is actually engaged within the neutral position. In other words, the control system 400 must be configured to generate 0% thrust across a large range of position data from the position sensor 229 (i.e., larger than the actual neutral position) to accommodate for the many sources of potential variation.

This results in control that feels unresponsive or "sloppy." Whereas the operator would expect the marine drive to produce thrust as soon as the detent is disengaged from the neutral position, no thrust would be generated until the throttle handle is moved even further from the neutral position and outside the dead band range of positions. In short, this results in undesired and unexpected operation of the marine drive.

In view of these challenges, the present inventor has developed the presently disclosed systems and methods for automatically determining the rotational position or positions in which the detent engages, including within the neutral position. In particular, the present inventor has discovered that the rotational positions of the detent (and specifically where the detent engages and/or disengages) can be identified through analysis of the position data that is generated by the position sensor 229.

The position in which the detent engages and/or disengages is identified by determining a change rate of the position data received from the position sensor as the throttle handle is rotated into and/or out of engagement. The detent engaging or disengaging is also referred to as a detent "crossing". The change rate of the position data may be velocity data calculated by taking the first derivative of the position data, and/or acceleration data calculated by taking the second derivative of the position data. The present inventor has recognized that detent crossings particularly pronounced in the velocity data or the acceleration data, as described further below. While the following description primarily focuses on detent crossings for the neutral position, it should be recognized that the same techniques can be applied to additional or alternative neutral positions.

In certain embodiments, the acceleration data, velocity data, and/or position data are compared to thresholds before analyzing whether a detent crossing has occurred, specifically to ensure that the data is valid. The thresholds may also be selected to ensure that the movement of the throttle arm is relatively linear and stable if the position data will be used to determine the detent positions. Thresholds may be compared for one or more of the position data, velocity data, and the acceleration data. The thresholds for the position data limit the measurements to those that are possible in view of all part-to-part, manufacturing, and other sources of variation for where the neutral detent may be positioned. This includes removing unreasonable values that are more likely due to position sensor errors and/or the like.

In the case of velocity data and acceleration data, the thresholds ensure that features or patterns in the data correspond to the detent engaging or disengaging, rather than the simply the way in which the operator moved the throttle handle. By way of example, the thresholds effectively filter out data from the operator moving the throttle unusually quickly, in an accelerating manner, or in a generally erratic manner. In certain embodiments the thresholds are threshold ranges having an upper end and a lower end in which the data must be positioned to be considered valid. The thresholds ensure that valid position data is being received, and that the throttle handle is being rotated in a smooth, consistent manner so as to avoid inaccuracies or errors. Through experimentation and development, the present inventor identified that a threshold range having a lower end of 400 ADC counts and an upper end of 550 counts functioned well, successfully identifying detent positions within 4 standard deviations of an average or expected detent position. In certain configurations, each ADC count represents approximately 0.17 degrees of rotation.

Once the position data, velocity data, and/or acceleration data are considered valid, the change rate (the velocity data and/or acceleration data) are analyzed to determine whether a detent crossing has occurred. One method for determining when a detent crossing has occurred is by comparing the change rate to a reference rate that corresponds to a reference detent engaging and/or disengaging (e.g., acceleration data collected from detent crossings of a similar detent). If the acceleration data determined from the position data is within a threshold of the reference rate, a detent crossing is determined to have occurred. Non-limiting examples of threshold ranges for valid velocity data are between 60 and 90 degrees per second or between 70 and 80 degrees per second. Non-limiting examples of threshold ranges for valid acceleration data are between −0.030 and 0.030 degrees per second squared and between −0.017 and 0.017 degrees per second squared.

Figure 8:
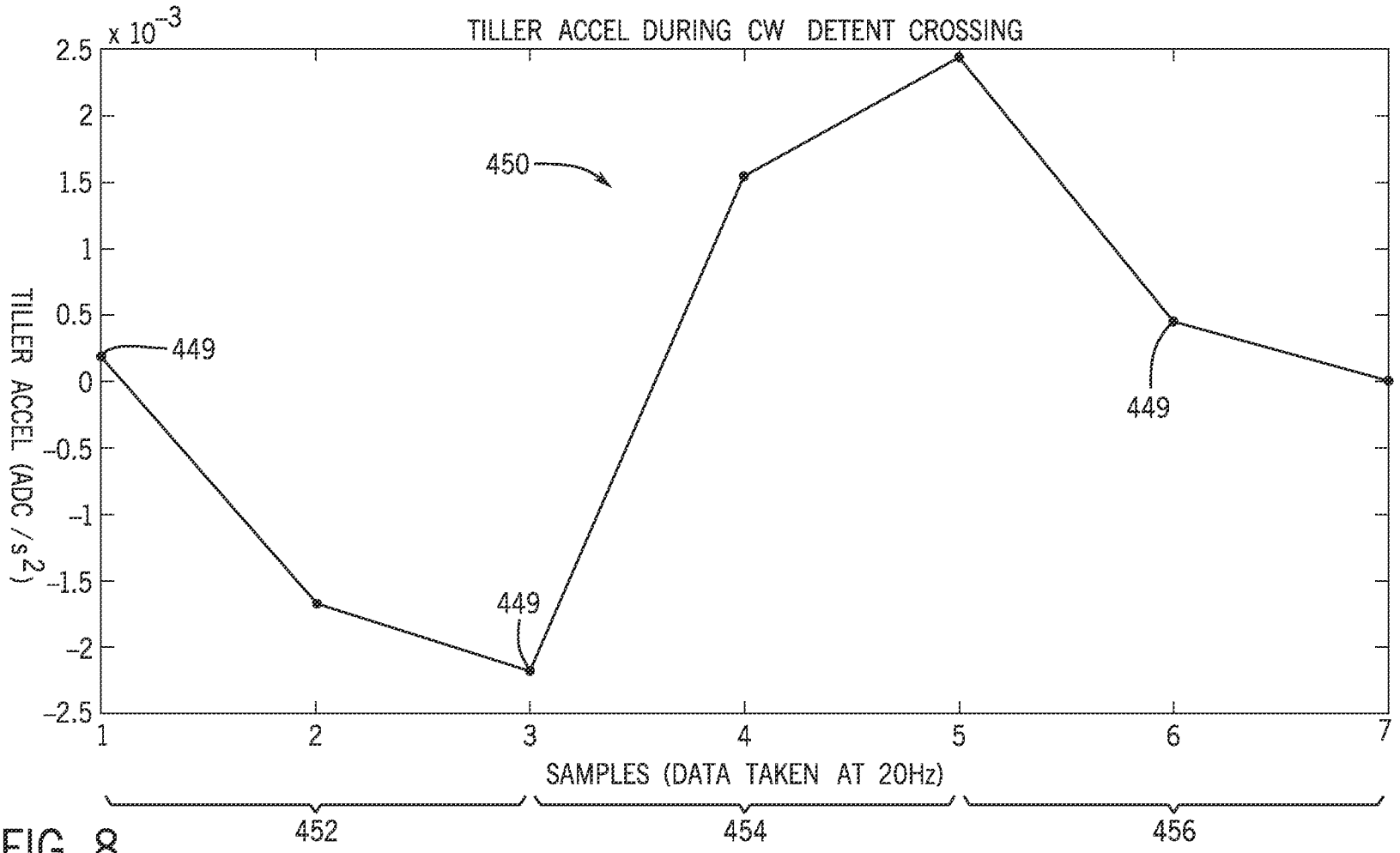
FIGS. 8 and 9 are reference waveforms corresponding to a reference detent engaging in clockwise and counterclockwise directions, respectively.
Figure 9:
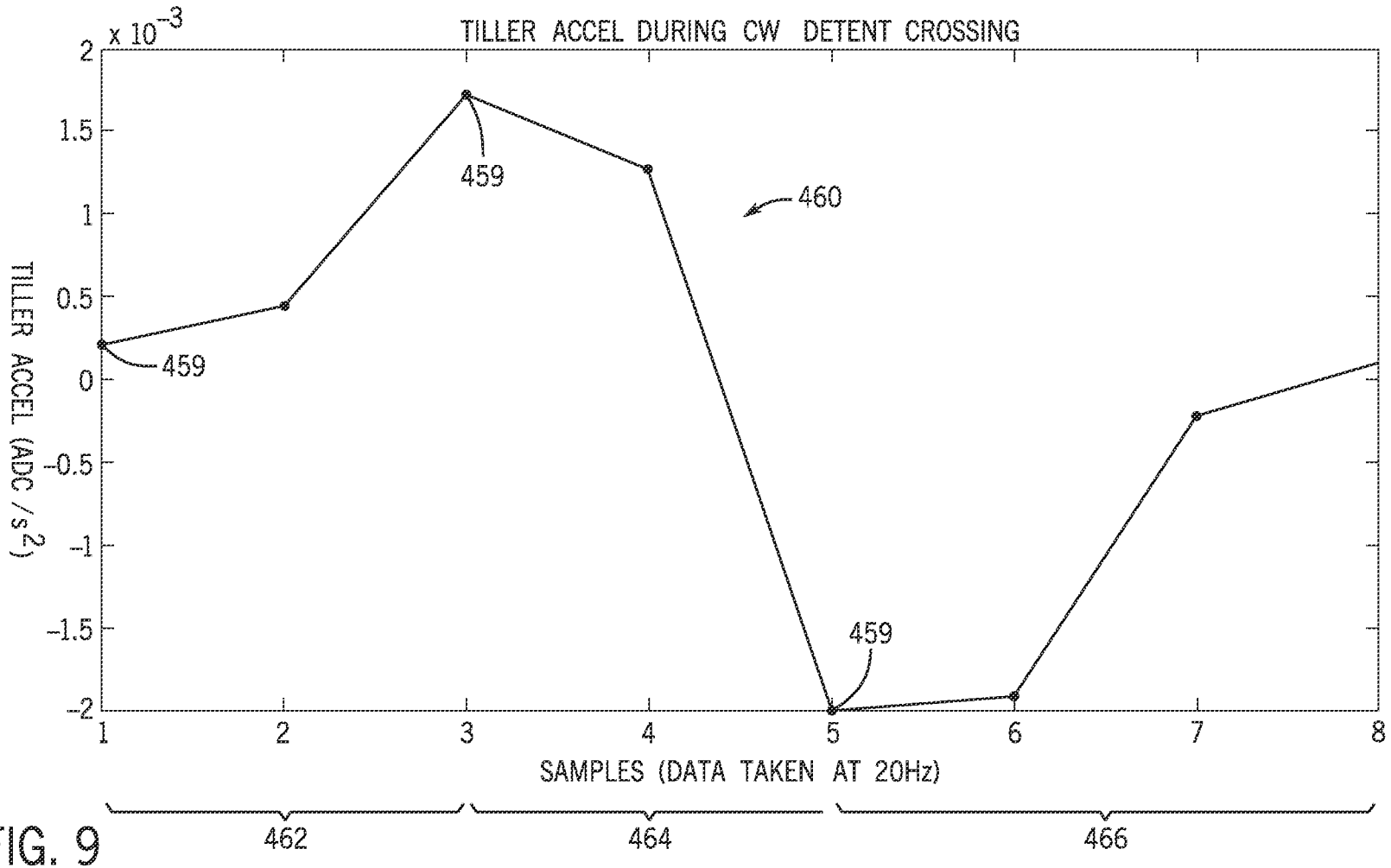

Another method for determining when a detent crossing has occurred is by comparing the calculated acceleration data to one or more stored reference waveforms corresponding to a reference detent engaging and/or disengaging. FIGS. 8 and 9 illustrate examples of reference waveforms 450, 460 corresponding to acceleration data determined from position data from a reference detent disengaging from the neutral position via clockwise CW rotation, and via counterclockwise CCW rotation, respectively. In other words, and with reference to FIG. 4, the reference waveform 450 of FIG. 8 corresponds to the detent crossing over the first neutral edge 280 on the top of the outer diameter of the shaft extension 228 and the reference waveform 260 corresponds to the detent crossing over the second neutral edge 281. It should be recognized that the reference waveforms 450, 460 shown may also or alternatively correspond to the reference detent engaging in the neutral position via clockwise CW and counterclockwise CCW rotation, crossing over the second neutral edge 281 and the first neutral edge 280, respectively. The units are shown as a function of counts from an analog to digital converter within the position sensor collecting the position data. However, the reference waveforms 450, 460 (and corresponding thresholds) may alternatively be provided as a function of other units such as radians or degrees. The reference waveforms 450, 460 may be stored in memory for reference and comparison (e.g., the memory system 420 of FIG. 7).

With reference to FIGS. 4 and 8, the reference waveform 450 shows acceleration data for a reference detent during a detent crossing in the clockwise CW direction. The calculated acceleration data points 449 within a first region 452 are shown declining as the roller pin 244 climbs the ramp of the contoured surface 246 from the neutral position 278 to the first neutral edge 280. Acceleration increases within a second region 454 after the first neutral edge 280 is passed and the roller pin 244 is guided down the contoured surface 246 to the right of the first neutral edge 280, The acceleration decreases again toward zero within a third region 456 at the first non-neutral edge 282.

With reference to FIGS. 4 and 9, the reference waveform 460 of FIG. 9 shows a similar detent crossing, now in the counterclockwise CCW direction. As with the reference waveform 450, the reference waveform 460 is discussed in relation to disengaging from the neutral position of the reference detent. However, similar looking references may also be provided for detent crossing in which the reference detent instead engages in the neutral position.

In the reference waveform 460, the calculated acceleration data points 459 begin in a first region 462 showing positive acceleration while the roller pin 244 climbs the ramp of the contoured surface 246 towards the second neutral edge 281. It should be recognized that in contrast to the first region 452 of FIG. 8, the acceleration is shown as positive in the first region 462 of FIG. 9 due to the negative values of calculating the velocity from the position data when rotating in the counterclockwise CCW direction (e.g., reducing ADC counts in sequential positions appears as a negative velocity). Thus, FIG. 9 shows a qualitatively opposite pattern as compared to FIG. 8. Once the roller pin 244 reaches (and subsequently passes) the second neutral edge 281, acceleration decreases (or increases in the negative direction) within a second region 464 as the roller pin 244 is guided down the contoured surface 246 to the left of the second neutral edge 281. Acceleration again increases (i.e., moves towards zero) within a third region 456 as the roller pin 244 moves towardly towards the second non-neutral edge 283 before stopping.

As discussed above, these reference waveforms may be used as a comparison for the acceleration data generated from the position data as the throttle handle moves, including through detent crossings. In certain embodiments, acceleration data points 449, 459 from the reference waveforms 450, 460 or relationships therebetween may be extracted for comparison (e.g., minimums, maximums, change rates between points, and/or the like). In other embodiments, an acceleration waveform is generated based on the calculated acceleration data for the position data (e.g., a moving window of points) such that the acceleration waveform and the reference waveforms can be directly compared. It should be recognized that the acceleration data waveform will substantially resemble the reference waveforms 450, 460 of FIGS. 8 and 9 when crossing the detent in the clockwise CW and counterclockwise CCW directions, respectively, and thus a separate acceleration waveform is not shown.

Comparing the calculated acceleration data and these reference waveforms 450, 460 may be performed in multiple different manners. In certain embodiments, thresholds are applied to the differences between the acceleration data and the reference waveforms similarly to that discussed above for ensuring the validity of the acceleration data itself. By way of example, a detent crossing may be determined to have occurred when the acceleration data points in a moving window are each within 10% or within 1 $(ADC/s)^2$ of data points in a same-sized moving window of the reference waveform.

In other embodiments, the calculated acceleration data (as an acceleration data waveform) and the reference waveforms 450, 460 are compared via convolution. In particular, the acceleration data waveform generated as the moving window of acceleration data calculated from the position data is multiplied by the reference waveform, subsequently calculating the integral of this product. The acceleration data waveform is then considered to substantially match that of the reference waveform when the integral exceeds a threshold, signifying a detent crossing has occurred. The present inventor has identified that using convolutions is particularly advantageous for identifying detent crossings. In short, the resultant waveform of the convolution is a function of the overlapping area of the two input waveforms (the acceleration data waveform and the reference waveform). If this overlapping area is too large, the convolution output will be too large (e.g., be greater than a threshold or upper end of a threshold range). If the overlapping area is too small, the convolution output will be too small (e.g., be less than a threshold or a lower end of a threshold range). The thresholds and/or threshold ranges may be identified by convoluting the reference waveform with itself. The output of the convolution in this case represents if the acceleration data waveform from the position sensor were to perfectly overlap with the reference waveform. Through experimentation, the present inventor has identified configurations in which the output of a convolution operation when the acceleration data waveform and the reference waveform overlap perfectly is approximately 0.000013. A tolerance or threshold range can then be applied to this output for which values are considered valid, e.g., values that are within +–0.00001 of the "ideal" value of approximately 0.000013.

The position of the throttle handle corresponding to the detent crossing can then be determined by identifying the underlying position data corresponding to the acceleration data waveform found to include the detent crossing. As discussed above, the position data forming the acceleration data waveform may include a moving window of several points, such as six acceleration data points. Additionally, when convolutions are used to identify detent crossings, the detent crossing is not identified until the detent crossing is complete, whereby a typical detent crossing may take approximately 120 milliseconds. In this case, there may be a fixed offset between the position at which the detent crossing occurred and the resultant acceleration data matching the reference data to detect this detent crossing. For example, a delay between the detent crossing and the acceleration data matching the reference data may depend upon the sampling rate of the position sensor 229 generating the underlying position data. In this case, the position of detent crossing would be a certain number of position data points before the point at which the crossing is detected in the acceleration data, such as 6 position data points for a sampling rate of 20 milliseconds (or alternatively, an offset of 120 milliseconds, 24 data points for a sampling rate of 5 milliseconds, and the like. It should be recognized that other times for detent crossings, other sampling rates, and other techniques for offsetting the detection of a detent crossing from the underlying position data of interest are also contemplated by the present disclosure.

With continued reference to FIG. 4, it should be recognized that the acceleration data matching the reference waveform of FIG. 8 corresponds to identifying the position of the first neutral edge 280 at which point the detent disengages, and likewise matching the reference waveform of FIG. 9 corresponds to identifying the position of the second neutral edge 281 at which point the detent disengages.

Once the first neutral edge 280 and the second neutral edge 281 are identified, the neutral position 278 can be determined as the midpoint therebetween. The neutral position 278 may alternatively be considered as another point between the first neutral edge 280 and the second neutral edge 281, or the entire range of positions therebetween (e.g., depending on the "play" of a particular detent). The position data generated by the position sensor 229 corresponding to the neutral position 278 can then be zeroed out or stored in the memory system such that the control system does not cause the marine drive to generate thrust at these position data measurements.

The same process can be applied to determine all detent engagement positions, such as the first idle position 284 between the first non-neutral edge 282 and the third non-neutral edge 288 and the second idle position 286 between the second non-neutral edge 283 and the fourth non-neutral edge 290. It should be recognized that different reference waveforms may be used for identifying these other detent positions.

It should further be recognized that it is not necessary to identifying multiple edges for a detent position. In other words, the control system may control the thrust based on a single position in which the detent is determined to disengage from the neutral position 278. By way of example, this single position (also referred to as a first position) may be the position from the position sensor 229 corresponding to the first neutral edge 280, the position immediately after the first neutral edge 280, the first non-neutral edge 282, the position immediately after the first non-neutral edge 282, or a range or points (e.g., a portion of the ramp of the contoured surface 246 clockwise CW from the first non-neutral edge 282, inclusive or exclusive of the first non-neutral edge 282 itself). This identified first position can also be used to provide estimated positions for other edges, both within the same detent position and others nearby. By way of example, it may be adequately accurate to assume that the second neutral edge 281 is 75 ADC counts less than the first neutral edge 280, or that the first non-neutral edge 282 is 100 ADC counts greater than the first neutral edge 280.

Once at least the first position is determined from the steps provided above, the control system 400 controls the marine drive to generate thrust when the throttle handle is moved into that first position. It should be recognized that this may be the start of thrust generation if rotating from the neutral position (e.g., clockwise CW into the first position), or may be a decreased in thrust if moving to the first position in the counterclockwise CCW direction. The thrust may be generated in a first direction when in the throttle handle is in the first position, such as in a forward direction.

The first position may be updated over time to accommodate for wear on the parts and to otherwise ensure accurate identification of detent engagement positions over time. By way of example, the first position may be determined on a periodic basis, such as being based on elapsed time or each time the marine drive is started up, and/or updated at every detent crossing during use of the marine drive.

The present inventor has identified that is advantageous to identify additional positions for basing control of the marine drive, such as a second position of the throttle handle in which the detent disengages from the neutral position when moving in a second direction opposite the first direction (i.e., rotating in the opposite direction of moving into first position discussed above). The control system 400 then controls the marine drive to generate thrust in an opposite direction when the throttle handle is position in the second position than in the first position, here in a reverse direction.

In certain embodiments in which another detent engagement position is provided, such as the first idle position 284 and/or second idle position 286 of FIG. 4, the control system 400 is configured to provide thrust at an idle speed when the detent is engaged therein. In the example provided above, this would mean forward thrust at an idle speed when the detent is engaged in the first idle position 284, and reverse thrust at an idle speed when the detent is engaged in the second idle position 286. It should be recognized that the thrust then increases once the throttle handle is rotated out of engagement with these detent positions. Moreover, in certain embodiments, the thrust continues to increase as the throttle handle is further rotated away from these idle positions.

In certain embodiments, an approximate or estimated position for the neutral position 278 may be used as a means of filtering out unreasonable position determinations and/or to determine which reference waveforms to apply for comparison. Alternatively, if there are a known number of detent engagement positions across the full range of rotational positions of the throttle handle, it is possible to determine which engagements and disengagements are associated with each engagement position by noting the direction in which the throttle handle rotates between them.

Figure 10:
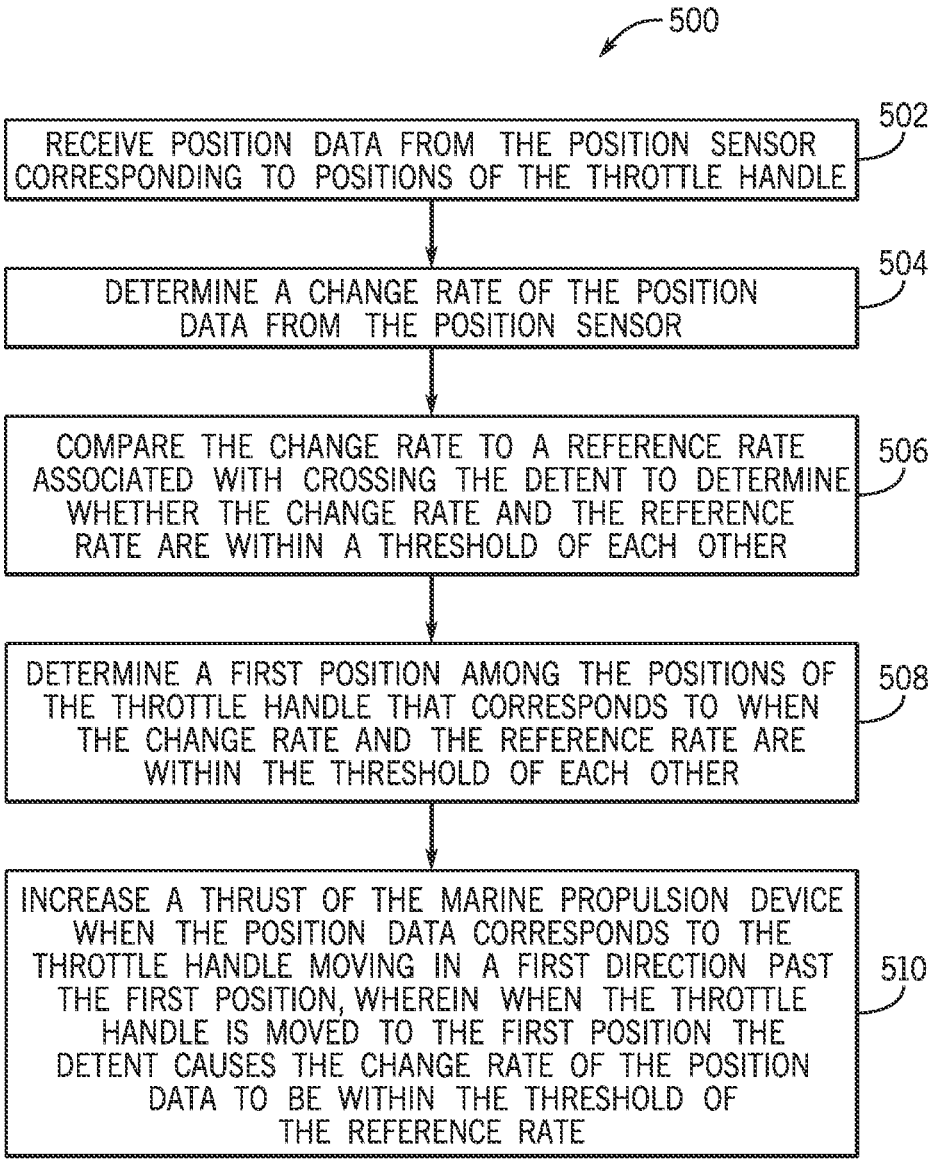
FIG. 10 is a flow chart for a first method for controlling a marine drive according to the present disclosure.
Figure 11:
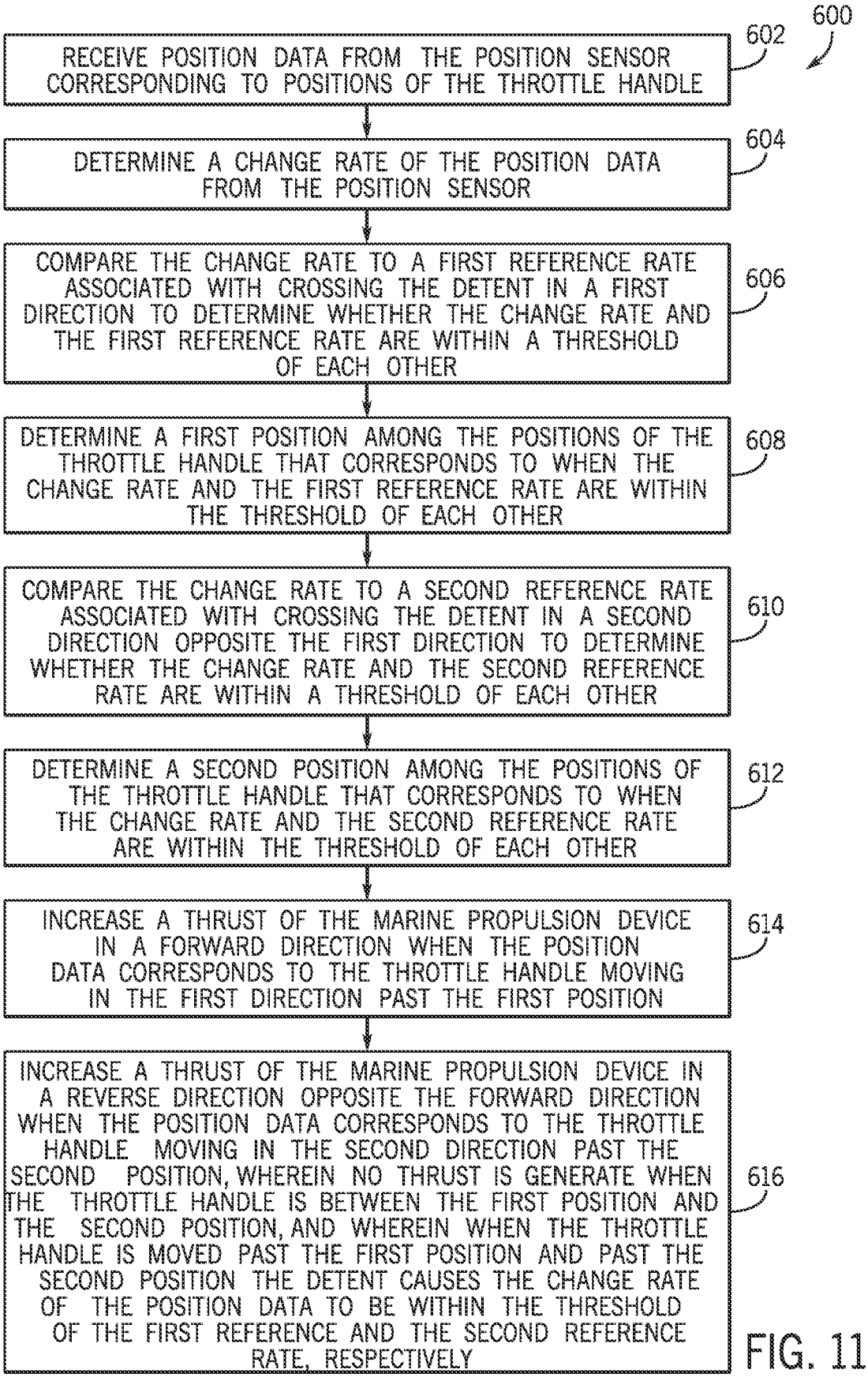
FIG. 11 is a flow chart for a second method for controlling a marine drive according to the present disclosure.

FIGS. 10 and 11 illustrate examples of methods for controlling a marine drive using the steps described above. In the method 500 of FIG. 10, step 502 provides that position data is received from the position sensor, whereby the position data corresponds to positions of the throttle handle as it moves. In step 504, a change rate is determined for the position data from the position sensor (e.g., calculating a second derivative to correspond to acceleration data). The change rate is compared in step 506 to a reference rate that is associated with a detent crossing of a reference detent to determine whether the change rate and the reference rate correspond to each other (e.g., being within a threshold of each other). Step 508 provides for determining a first position from among the positions of the throttle lever that corresponds to when the change rate and the reference rate were found to correspond to each other. The detent causes the change rate of the position data to correspond to the reference rate when the throttle handle is moved to the first position. The thrust of the marine drive is increased in step 510 when the position data corresponds to the throttle handle moving in a first direction past the first position.

In the method 600 of FIG. 11, a second position is also identified, whereby thrust is generated in an opposite direction when the throttle handle is in the second position as compared when the throttle handle is in the first position. The method 600 begins with step 602 through steps 608 corresponding to steps 502 through step 508 of the method 500 of FIG. 10. Steps 610 and 612 are similar to steps 606 and 608, but whereby the change rate is compared to a second reference rate. The thresholds of steps 610 and 612 may vary from that of steps 606 and 608. In step 614, the thrust is generated in a forward direction when the position data corresponds to the throttle handle moving in the first direction to or past the first position. In step 616, the thrust is generated in a reverse direction opposite the forward direction when the position data corresponds to the throttle handle moving in the second direction to or past the second position. No thrust is generated when the throttle handle is between the first position and the second position.

In this manner, the presently disclosed systems and methods provide for automatically determining the actual positions in which the detent engages and disengages as the throttle handle rotates. This preserves time and effort for calibrating the position sensor, as well as providing more accurate mapping between the position data that should results in thrust being generated and the position data that should not. The determination of detent engagement positions may also be updated over time so as to account not only for part-to-part variation, manufacturing variation, tool variation, and the like, but also wear and/or drift over time.

In the present description, certain terms have been used for brevity, clarity, and understanding. No unnecessary limitations are to be implied therefrom beyond the requirement of the prior art because such terms are used for descriptive purposes only and are intended to be broadly construed. The different apparatuses described herein may be used alone or in combination with other apparatuses. Various equivalents, alternatives and modifications are possible within the scope of the appended claims.

What is claimed is:

1. A method for controlling a marine drive having a throttle handle moveable to control a thrust and a detent engageable to resist moving the throttle handle, the method comprising:

configuring a position sensor to generate position data corresponding to positions of the throttle handle;

receiving the position data from the position sensor;

analyzing the position data to detect that the detent has disengaged and determine a first position of the throttle handle when the detent is detected to have disengaged; and generating thrust with the marine drive when the throttle handle is moved into the first position.

2. The method according to claim 1, wherein analyzing the position data to determine the first position comprises:

determining a change rate of the position data when the detent is at least one of engaging and disengaging;

determining when the change rate is within a threshold of a reference rate associated with a reference detent the at least one of engaging and/or disengaging; and determining the first position to correspond to when the change rate is within the threshold of the reference rate.

3. The method according to claim 2, wherein the threshold is a first threshold and the reference rate is a first reference rate associated with the reference detent engaging, and wherein the thrust is generated in a forward direction when the throttle handle is in the first position, further comprising determining a second position of the throttle handle in which the detent disengages when moving in a second direction opposite the first direction based on when the change rate is within a second threshold of a second reference rate associated with the reference detent disengaging, further comprising generating a thrust in a reverse direction opposite the forward direction when the throttle handle is moved into the second position.

4. The method according to claim 3, wherein the first reference rate comprises a first reference waveform and the second reference rate comprises a second reference waveform, and wherein determining when the change rate is within the first threshold of the first reference waveform and within the second threshold of the second reference waveform comprises convoluting the change rate and the first reference waveform and convoluting the change rate and the second reference waveform, respectively.

5. The method according to claim 2, wherein the change rate is determined as a second derivative of the position data.

6. The method according to claim 2, further comprising updating the change rate on a periodic basis.

7. The method according to claim 6, wherein the change rate is updated each time the detent engages, and wherein the first position is updated each time the change rate is within the threshold of the reference rate.

8. The method according to claim 1, wherein the first position comprises a range of positions.

9. The method according to claim 1, further comprising increasing the thrust generated by the marine drive when the throttle handle moves farther from the first position.

10. The method according to claim 1, wherein the throttle handle comprises a rotatable tiller handle and the positions of the rotatable tiller handle correspond to rotational positions.

11. The method according to claim 1, wherein the thrust is increased when the throttle handle moves in a first direction away from the first position, further comprising decreasing the thrust of the marine drive when the throttle handle moves towards the first position in a second direction opposite the first direction.

12. A method for controlling a marine drive having a throttle handle moveable to control a thrust and a detent engageable to resist moving the throttle handle, the method comprising:

configuring a position sensor to generate position data corresponding to positions of the throttle handle;

receiving the position data from the position sensor;

analyzing the position data to determine a first position of the throttle handle in which the detent disengages, wherein the detent is disengaged by moving the throttle handle to the first position in a first direction to generate the thrust in a forward direction, and analyzing the position data to determine a second position of the throttle handle in which the detent disengages when moving in a second direction opposite the first direction; and generating thrust with the marine drive when the throttle handle is moved into the first position, and a thrust in a reverse direction opposite the forward direction when the throttle handle is moved into the second position.

13. The method according to claim 12, wherein the detent is engageable in a neutral position, a first idle position, and a second idle position, wherein the first position is determined to correspond to the detent being disengaged from the neutral position and engaged in the first idle position and the second position is determined to correspond to the detent being disengaged from the neutral position and engaged in the second idle position.

14. The method according to claim 13, wherein the thrust is generated at an idle speed in the forward direction when the detent is engaged in the first idle position and at an idle speed in the reverse direction when the detent is engaged in the second idle position.

15. The method according to claim 14, further comprising analyzing the position data to determine a third position of the throttle handle in which the detent disengages from the first idle position when moving in the first direction, analyzing the position data to determine a fourth position of the throttle handle in which the detent disengages from the second idle position when moving in the second direction, increasing the thrust in the forward direction when the throttle handle moves past the third position in the first direction, and increasing the thrust in the reverse direction when the throttle handle moves past the fourth position in the second direction.

16. A control system for controlling a marine drive having a throttle handle moveable to control a thrust and a detent engageable to resist moving the throttle handle, the control system comprising:

a position sensor that generates position data corresponding to positions of the throttle handle;

a controller operatively coupled to the position sensor, the controller being configured to:

receive the position data from the position sensor;

analyze the position data to detect that the detent has disengaged and determine a first position of the throttle handle when the detent is detected to have disengaged; and generate thrust with the marine drive when the throttle handle is moved into the first position.

17. The control system according to claim 16, further comprising a memory system storing a threshold and a reference rate corresponding to a reference detent engaging, wherein the controller is configured to determine the first position by:

determining a change rate of the position data when the detent is engaging;

determining when the change rate is within the threshold of the reference rate; and determining the first position to correspond to when the change rate is within the threshold of the reference rate.

18. The control system according to claim 17, wherein the detent is disengaged by moving the throttle handle to the first position in a first direction to generate the thrust in a forward direction, wherein the controller is further configured to analyze the position data to determine a second position of the throttle handle in which the detent disengages when moving in a second direction opposite the first direction and to generate a thrust in a reverse direction opposite the forward direction when the throttle handle is moved into the second position.

19. The control system according to claim 18, wherein the detent is engageable in a neutral position, a first idle position, and a second idle position, wherein the first position is determined to correspond to the detent being disengaged from the neutral position and engaged in the first idle position and the second position is determined to correspond to the detent being disengaged from the neutral position and engaged in the second idle position.

20. The control system according to claim 19, wherein the thrust is generated at an idle speed in the forward direction when the detent is engaged in the first idle position and at an idle speed in the reverse direction when the detent is engaged in the second idle position, wherein the controller is further configured to analyze the position data to determine a third position of the throttle handle in which the detent disengages from the first idle position when moving in the first direction and a fourth position of the throttle handle in which the detent disengages from the second idle position when moving in the second direction, and wherein the controller is further configured to increase the thrust in the forward direction when the throttle handle moves past the third position in the first direction and to increase the thrust in the reverse direction when the throttle handle moves past the fourth position in the second direction.

* * * * *